US006042692A

United States Patent [19]

Myrén

[11] Patent Number: 6,042,692

[45] Date of Patent: Mar. 28, 2000

[54] PAPER MACHINE FOR MANUFACTURING A WEB OF SOFT CREPE PAPER

[75] Inventor: Harry Ingemar Myrén, Karlstad, Sweden

[73] Assignee: Valmet-Karlstad AB, Sweden

[21] Appl. No.: 08/676,467

[22] Filed: Jul. 8, 1996

[30] Foreign Application Priority Data

Jul. 12, 1995 [SE] Sweden ..... 9502570

[51] Int. Cl.[7] ..... B31F 1/12

[52] U.S. Cl. ..... 162/281; 162/297; 162/306; 162/359.1; 162/111; 162/207

[58] Field of Search ..... 162/280, 281, 162/306, 297, 359.1, 111, 207; 34/115, 116

[56] References Cited

U.S. PATENT DOCUMENTS

| | | | |
|---|---|---|---|
| 3,303,576 | 2/1967 | Sisson | 162/297 |
| 3,812,000 | 5/1974 | Salvucci, Jr. et al. | 162/112 |
| 3,821,068 | 6/1974 | Shaw | 162/112 |
| 3,926,716 | 12/1975 | Bates | 162/113 |
| 4,036,684 | 7/1977 | Schmitt et al. | 162/290 |
| 4,102,737 | 7/1978 | Morton | 162/359.1 |
| 5,274,930 | 1/1994 | Ensign et al. | 34/23 |
| 5,397,437 | 3/1995 | Myren | 162/359.1 |

*Primary Examiner*—Peter Chin
*Attorney, Agent, or Firm*—Alston & Bird LLP

[57] ABSTRACT

A paper machine for manufacturing a web of soft crepe paper comprises a wet end (1) having at least one forming wire (4) for forming and supporting a web (7), and a drying section (2) with a through drying machine (13), a drying cylinder (17) and a perforated belt (19) running around a through-blow cylinder of the through drying machine and a transfer roll (21) at the drying cylinder, the web running through the through drying machine being exposed to drying air after its transfer from the forming wire. The belt (19) and the web (7) move from the through drying machine (13) to the drying cylinder (17) in a run that is free from mechanical means which would compress the web, whereby in said run the surface of the web which is exposed to the drying air faces away from the belt and remains free from contact with such means up to the drying cylinder.

7 Claims, 1 Drawing Sheet

PAPER MACHINE FOR MANUFACTURING A WEB OF SOFT CREPE PAPER

FIELD AND BACKGROUND OF THE INVENTION

The present invention relates to a paper machine for manufacturing a web of soft crepe paper.

It is known to utilize through drying in the manufacture of soft crepe paper in order to pre-dry the web without compressing it. Through drying is effected using a through drying machine based on two different techniques, said through drying machine having a cylinder with perforated shell around which the web runs accompanied by a perforated belt of wire type. According to one technique air is pressed and/or sucked from outside and into the through-blow cylinder. In the other technique air is pressed and/or sucked in the other direction, i.e. from the inside and out through the through-blow cylinder.

Solutions have been suggested for the "from the inside and out" technique, see U.S. Pat. No. 3,303,576, U.S. Pat. No. 4,036,684 and U.S. Pat. No. 5,274,930 (FIG. 3B), for example, wherein after its removal from the forming unit and up to the drying cylinder or a transfer roll beside it, the wire-supported web is not subjected to any compression by guide rolls. However, the wire running outside the web in the through drying machine may have a certain compressive action on the web. Due to the pressure drop that occurs through the web and the wire, the web is lifted from the through-blow cylinder so that the normal pressure between this and the web becomes extremely low. However, lifting the web from the through-blow cylinder gives rise to loss of drying air since, instead of passing straight through the web, the drying air flows out to the sides through the gap formed when the web is lifted from the through-blow cylinder. Besides these losses of drying air, the method results in uneven drying of the web seen in cross section. In order to reduce the losses of drying air disappearing from the side edges of the web, the velocity of the air which is to pass through the web must be limited. The through drying machine thus has limited drying effect, and also limited usefulness as regards the type of pulp formed to a web with sufficient permeability to air for the through drying machine with reduced effect.

Solutions for the "from the outside and in" technique have been proposed, see U.S. Pat. No. 3,812,000 and U.S. Pat. No. 3,821,068, for example, in which the web runs through the through drying machine with one surface being exposed to the drying air. The web carried by the wire reaches the drying cylinder via guide rolls, the surface of the web exposed to drying air being in contact with the guide rolls, while at the same time the wire exerts a pressure on the web so that it is compressed in an undesirable manner. Since the web is in direct contact with said guide rolls, there is a risk of fibres adhering to them, thereby causing fibre losses and the web being damaged by accumulations of fibres that have gradually collected on the guide rolls. The guide rolls must therefore be cleaned. An arrangement with guide rolls entails increased costs and requires space, which increases the total space requirement for the paper machine. U.S. Pat. No. 5,274,930 (FIGS. 2 and 3A) also proposes drying air being blown through from the outside to the inside, however, it must first pass through the wire covering the web which results in considerably poorer drying effect due to restricted air temperature in comparison with a web having one side exposed to the drying air as described in U.S. Pat. No. 3,812,000, where every small surface unit is in prolonged contact with drying air as the web passes through the through drying machine. Furthermore, the wire carrying the web in U.S. Pat. No. 5,274,930 must be passed around guide rolls up to the drying cylinders. As mentioned earlier, an arrangement with guide rolls involves increased costs and requires space, thereby increasing the total space requirement of the paper machine. Although the web is not compressed in this case, when it passes over the guide rolls on the outside of the wire, it is still subjected to compression when it passes through the through drying machine due to the pressure exerted by the wire on the web during its movement around the through-blow cylinder and this pressure increases since the drying air acts directly on the wire.

SUMMARY OF THE INVENTION

The object of the present invention is to eliminate the problems mentioned above and provide a paper machine for manufacturing a web of soft crepe paper which is not subjected to any compression from its transfer from the forming wire up to the drying cylinder.

The present invention relates to a paper machine for manufacturing a web of soft crepe paper, comprising a wet end having at least one forming wire for forming and supporting a web, and a drying section comprising a through drying machine having a housing with a chamber for drying air, a cylinder rotatably journalled in the housing and having a perforated shell for the drying air to blow through; a drying cylinder; and a perforated belt of wire type which runs in a loop around a plurality of rolls, around said through-blow cylinder and around a transfer roll forming a nip with the drying cylinder, said belt running in contact with the forming wire in a transition zone having transfer means for transferring the web from the forming wire to the belt, and the web being arranged to run, with the aid of the belt, through the through drying machine with one surface exposed to the drying air in said chamber, said belt and said web carried thereon being moved from the through drying machine to the drying cylinder in a run that is free from mechanical means which would compress the web, whereby in said run the surface of the web which is exposed to drying air faces away from the belt and remains free from contact with such mechanical means up to the drying cylinder.

The invention will be further explained in the following with reference to the accompanying drawings.

DESCRIPTION OF PREFERRED EMBODIMENT

Figure 1:
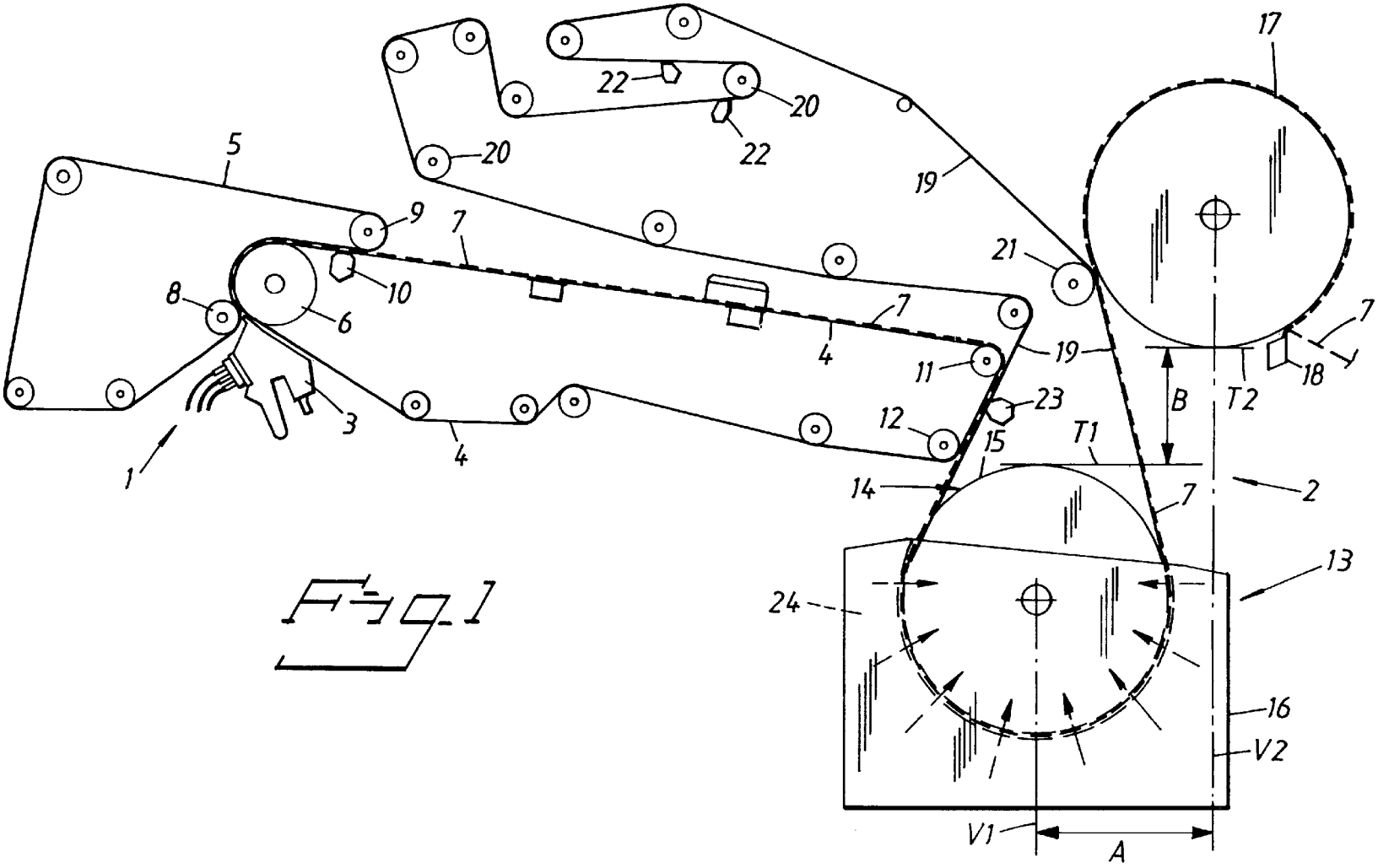
FIG. 1 shows schematically a paper machine for manufacturing a web of soft crepe paper in accordance with the invention.

FIG. 1 shows schematically parts of a conventional paper machine suitable for manufacturing a web of soft crepe paper such as tissue and other sanitary paper products. The paper machine shown is a twin wire former and comprises a wet end 1 and a drying section 2. The wet end comprises a headbox 3, a movable supporting forming wire 4, a movable covering forming wire 5 and a forming cylinder 6 which may be perforated and provided with suction means. The forming cylinder 6 may alternatively be smooth. The headbox 3 shown delivers a multi-layer jet of stock between the two movable forming wires 4, 5 in order to form a web 7 by dewatering the stock. Alternatively a headbox 3 may be used which delivers a single-layer jet of stock. The two forming wires 4, 5 run together over the forming cylinder 6 and then in individual loops over a plurality of rolls arranged to drive, guide, direct and tension the supporting forming wire 4 and the covering forming wire 5. The rolls forming the loop of the covering forming wire 5 comprise a breast roll 8 and a guide roll 9, which may be designated as a nose roll, located a short distance after the forming cylinder 6. The covering forming wire 5 leaves the supporting forming wire 4 and the web 7 when it passes around the nose roll 9, whereby the web 7 is retained on the supporting forming wire 4 with the aid of a transfer suction box 10 or some other transfer means located between the forming cylinder 6 and the nose roll 9. The supporting forming wire 4 continues to the drying section 2 where its direction of movement is altered first around an upper guide roll 11 and then around a lower guide roll 12.

The drying section 2 comprises a through drying machine 13 having a trough-like housing 16 with a chamber 24 for drying air. The through drying machine 13 has also a cylinder 14 rotatably journalled in the housing 16, said cylinder having a perforated shell 15 for the drying air to blow through. Drying air having a predetermined temperature is supplied to the chamber 24 to be forced from the outside, through to the inside of the through-blow cylinder 14, the used air being withdrawn therefrom in suitable manner. The drying section 2 also includes a drying cylinder 17 having relatively large diameter and a smooth envelope surface. The drying cylinder 17, preferably a Yankee cylinder, is covered by a hood (not shown), from which hot air is blown at high speed towards the web 7. The web is creped off the Yankee cylinder 17 with the aid of a doctor blade 18 to obtain the desired creping, after which the finished, creped web 7 is wound onto a reel (not shown). The drying section 2 also includes an endless, perforated belt 19, pervious to air and liquid, arranged upstream of the Yankee cylinder and running in a loop around a plurality of rolls 20, the through-blow cylinder 14 of the through drying machine 13 and a transfer roll 21, which presses against the Yankee cylinder 17 and is provided with suction means (not shown) in order to dewater the web 7 before it comes into contact with the Yankee cylinder 17.

Following the transfer roll 21 are two cleaning boxes 22 in order to clean the belt 19. The belt 19 encounters the supporting forming wire 4 after the upper guide roll 11 and leaves it before the lower guide roll 12 so that a transition zone is formed therebetween which includes a transfer suction box 23 arranged in the loop of the belt 19. During this run the web 7 is transferred from the forming wire 4 to the belt 19 with the aid of the transfer suction box 23.

In the embodiment shown the belt 19, and thus the web 7, moves in a linear run from through-blow cylinder 14 to Yankee cylinder 17. The web 7 and belt 19 also move in a linear run from the transfer suction box 23 up to the through-blow cylinder 14. If desired, guide rolls may be arranged both before and after the through drying machine 13 in the loop of the belt 19. The guides rolls deflect suitably at a small angle the direction of the belt 19 depending on the location of the through drying machine 13 in relation to the drying cylinder 17 and transfer suction box 23. Thanks to the unique placing of the through drying machine 13 in relation to the drying cylinder 17, such guide rolls, which would make the arrangement more expensive, are in most cases unnecessary. It is important, however, that in both embodiments (with and without guide rolls, respectively) one and the same surface of the web is free from contact with any mechanical means from the transition point 23 right up to the drying cylinder 17 and that the web is not subjected to any compression during this travel.

The through drying machine 13 is located below and to the side of the drying cylinder 17 so that the upper horizontal tangent T1 of the through-blow cylinder 14 is located below the lower horizontal tangent T2 of the drying cylinder 17 and so that the distance A between two vertical lines V1, V2 intersecting the through-blow cylinder 14 and the drying cylinder 17 centrally is about 0–1.2, preferably about 0.4–0.8 times the combined length of the radii of said cylinders 14, 17. The distance B between said two tangents T1, T2 is suitably at least about 0.2, preferably at least 0.5 times the radius of the through-blow cylinder. Most preferably the last-mentioned distance B is about 0.8–1.2 times the radius of the through-blow cylinder.

The invention has been described in conjunction with a twin wire former. However, it can of course also be utilized on a fourdrinier wire or breast-roll former.

That which is claimed is:

1. A paper machine for manufacturing a web of soft crepe paper, comprising a wet end having at least one forming wire for forming and supporting a web, and a drying section comprising a through drying machine having a housing with a chamber for drying air, a through-blow cylinder rotatably journalled in the housing and having a perforated shell for the drying air to blow through; a drying cylinder; a doctor blade for creping the web from said drying cylinder; and a perforated belt of wire type which runs in a loop around a plurality of rolls, around said through-blow cylinder and around a transfer roll forming a nip with the drying cylinder, said belt running in contact with the forming wire in a transition zone having transfer means for transferring the web from the forming wire to the belt in said transition zone, the web being carried on the belt through the through drying machine with one surface exposed to the drying air in said chamber, said belt and the web carried thereon being moved from the through drying machine to the drying cylinder in a run that is free from mechanical means which would compress the web, whereby in said run the surface of the web which is exposed to drying air faces away from the belt and remains free from contact with such mechanical means up to the drying cylinder, and wherein the through drying machine is located below and to the side of the drying cylinder so that an upper horizontal tangent of the through-blow cylinder is located below a lower horizontal tangent of the drying cylinder and so that the distance between two vertical lines intersecting the centra of the through-blow cylinder and the drying cylinder is about 0–1.2 times the combined length of the radii of said cylinders.

2. A paper machine as defined in claim 1 wherein the distance between said two tangents is at least about 0.2 times the radius of the through-blow cylinder.

3. A paper machine as defined in claim 1 or 2 wherein said belt and the web move in a linear run from the through-blow cylinder to the drying cylinder.

4. A paper machine as defined in claim 3 wherein said belt and the web move in a linear run from said transition zone to the through-blow cylinder.

5. A paper machine as defined in claim 1 wherein the distance between the two vertical lines is about 0.4–0.8 times the combined length of the radii of said cylinders.

6. A paper machine as defined in claim 2 wherein the distance between said two tangents is at least about 0.5 times the radius of the through-blow cylinder.

7. A paper machine as defined in claim 6 wherein the distance between said two tangents is about 0.8–1.2 times the radius of the through-blow cylinder.

* * * * *